US010532607B2

(12) United States Patent
Wager

(10) Patent No.: US 10,532,607 B2
(45) **Date of Patent: *Jan. 14, 2020**

(54) APPARATUS FOR ROLLER PAINTING

(71) Applicant: PaintBTR, LLC, St. Petersburg, FL (US)

(72) Inventor: Martin Wager, St. Petersburg, FL (US)

(73) Assignee: PaintBTR, LLC, St. Petersburg, FL (US)

( * ) Notice: Subject to any disclaimer, the term of this patent is extended or adjusted under 35 U.S.C. 154(b) by 101 days.

This patent is subject to a terminal disclaimer.

(21) Appl. No.: 15/661,783

(22) Filed: Jul. 27, 2017

(65) Prior Publication Data

US 2018/0001697 A1 Jan. 4, 2018

Related U.S. Application Data

(63) Continuation of application No. 15/197,816, filed on Jun. 30, 2016, now Pat. No. 9,744,802.

(51) Int. Cl.
*B44D 3/12* (2006.01)
*B05C 17/02* (2006.01)

(52) U.S. Cl.
CPC ..... *B44D 3/126* (2013.01); *B05C 17/0245* (2013.01)

(58) Field of Classification Search
CPC ..... B44D 3/126; B05C 17/0245
See application file for complete search history.

(56) References Cited

U.S. PATENT DOCUMENTS

| | | | |
|---|---|---|---|
| 1,111,159 | A | 9/1914 | Knox |
| 1,813,670 | A | 7/1931 | Kessler |
| 1,959,584 | A | 5/1934 | Hurley |
| 2,471,189 | A | 5/1949 | Bartels |
| 2,511,111 | A | 6/1950 | Jakubowski |
| 2,606,694 | A | 8/1952 | Galletta |
| 2,659,096 | A | 11/1953 | Mencfeldowski, Jr. |
| 2,659,917 | A | 11/1953 | Drum |
| 2,705,334 | A | 4/1955 | Farrow |
| 2,849,158 | A | 8/1958 | Hopla |
| 3,576,045 | A | 4/1971 | Stafford |
| 3,602,939 | A | 9/1971 | Schoenholz |
| 3,732,593 | A | 5/1973 | Habostad |

(Continued)

FOREIGN PATENT DOCUMENTS

| | | |
|---|---|---|
| FR | 1082819 | 1/1955 |
| GB | 2460127 | 11/2009 |

*Primary Examiner* — Laura C Guidotti
(74) *Attorney, Agent, or Firm* — Larson & Larson, P.A.; Frank Liebenow; Justin P. Miller

(57) ABSTRACT

An apparatus for wetting a roller (e.g. with paint) includes a liquid containment area having a first side wall, a second side wall, a first end wall and a second end wall, and a sloping bottom section connected to form a rectangular container capable of holding a liquid. The sloping bottom section slopes such that a first end of the rectangular container is deeper than a distal opposing end such that the liquid tends to drain and pool in the first end. A lip extends inwardly continuously around the top edges of the side walls. The lip reduces spilling of paint, adds stiffness to the tray, and provides a base for the attachment of a roller cleaning mesh. In some embodiments, a roller cleaning mesh is mounted to the lip above the first end for rolling a roller over to remove debris from the roller.

11 Claims, 3 Drawing Sheets

(56) References Cited

U.S. PATENT DOCUMENTS

| | | | | |
|---|---|---|---|---|
| 4,240,568 | A | 12/1980 | Pool | |
| 5,195,662 | A | 3/1993 | Neff | |
| 6,736,969 | B2 | 5/2004 | Milne | |
| 7,992,250 | B2 | 8/2011 | Prokop | |
| 8,281,952 | B2 | 10/2012 | Robellard | |
| 9,145,026 | B2 | 9/2015 | Sorenson | |
| 9,168,781 | B1 | 10/2015 | Cooper | |
| 9,744,802 | B1 * | 8/2017 | Wager | B44D 3/006 |
| 2002/0096525 | A1 | 7/2002 | Bertoldo | |
| 2003/0012887 | A1 | 1/2003 | Orlikowski | |
| 2006/0005343 | A1 | 1/2006 | Clingerman | |
| 2010/0089931 | A1 | 4/2010 | Sheehy | |
| 2010/0230413 | A1 | 9/2010 | Crudgington, Jr. | |
| 2015/0209822 | A1 | 7/2015 | Enguita | |

* cited by examiner

APPARATUS FOR ROLLER PAINTING

CROSS-REFERENCE TO RELATED APPLICATION

This application is a continuation of U.S. patent application Ser. No. 15/197,816, filed Jun. 30, 2016, the disclosure of which is hereby incorporated by reference.

FIELD

This invention relates to the field of coatings and more particularly to a system for coating using a roller device.

BACKGROUND

There are many ways to coat objects. The art of coating, often referred to as painting, uses various tools to coat surfaces including brushes, rollers, sprayers, foam brushes, etc. In general, many things are coated with various materials such as paint, varnish, polyurethane, stain, etc.

Often, it is desired to coat a surface with a smooth coating of a material such as paint. Much attention is taken to apply a smooth coat of paint or other coatings. People who apply coatings (e.g. painters), work hard to apply clean, even coats; painting in specific patterns, using high-quality brushes and rollers, etc. No matter how hard such people work at applying clean, even coats, impurities often hamper such efforts. Paint impurities come from many sources. Old paint often congeals or fragmented pieces of dried paint often find their way into the paint and onto the paint applicator. Other sources of such contamination come from the environment, dust, hair, animal hair, dirt, soil, insects, etc. When such contamination mixes into the paint and winds up on the applicator (e.g., brush, roller, etc.), the contamination winds up on the applicator, then eventually winds up on the target that is being coated (e.g., wall). The contamination causes uneven coating on surfaces, smearing, bumps, and other marring of a quality coating.

When painting with a roller, contamination on the roller often transfers to the surface being coated or remains on the roller, but causes uneven coating when the contamination contacts the surface. Applying a layer of paint on an outside wall near the grass or dirt is almost impossible, as pieces of grass or dirt almost always wind up on the roller. Once the contamination finds its way onto the roller, the contamination often remains on the roller, or is transferred to the surface being coated. The person applying the paint often uses a finger or rag to remove the contamination, piece by piece, but such is messy and time consuming.

For commercial painters, often an inspection is made by an inspector or project manager and, should any debris be found on a painted surface, the commercial painter is often required to sand to remove the debris and repaint the entire surface.

In addition, roller wetting systems often lack the ability to hold substantial amounts of coating material as paint often sloshes within the containment areas and spills over the sides, limiting the amount of coating What is needed is a system that reduces spillage from a roller wetting apparatus.

SUMMARY

In one embodiment, a system for wetting a roller is disclosed including a first side wall, a second side wall, a first end wall and a second end wall, the ends of such connected to form a rectangular wall set. A bottom section is connected to bottom edges of the first side wall, the second side wall, the first end wall and the second end wall, forming a rectangular container capable of containing a liquid. A lip extends inwardly from a top edge of each of the first side wall, the second side wall, the first end wall, and the second end wall, the lip for reducing spilling of paint from the system for wetting a roller.

In another embodiment, an apparatus for wetting a roller is disclosed including a liquid containment area having a first side wall, a second side wall, a first end wall and a second end wall, and a sloping bottom section connected to form a rectangular container capable of holding a liquid. The sloping bottom section slopes such that a first end of the rectangular container is deeper than a distal opposing end such that the liquid tends to drain and pool in the first end. A lip extends inwardly continuously around a top edge of each of the first side wall, the second side wall, the first end wall, and the second end wall, The lip is for reducing spilling of paint from the system for wetting a roller and for stiffening the apparatus for wetting a roller, and optionally for supporting a mesh.

In another embodiment, an apparatus for wetting a roller is disclosed including a liquid containment area having a first side wall, a second side wall, a first end wall and a second end wall, and a sloping bottom section connected to form a rectangular container capable of holding a liquid. The sloping bottom section sloping such that a first end of the rectangular container is deeper than a distal opposing end such that the liquid tends to drain and pool in the first end. A lip extends inwardly continuously around a top edge of each of the first side wall, the second side wall, the first end wall, and the second end wall, the lip for reducing spilling of paint from the system for wetting a roller. A roller cleaning mesh is mounted to the lip above the first end for rolling a roller over such to remove debris/contaminants from the roller before re-wetting the roller with the coating material.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
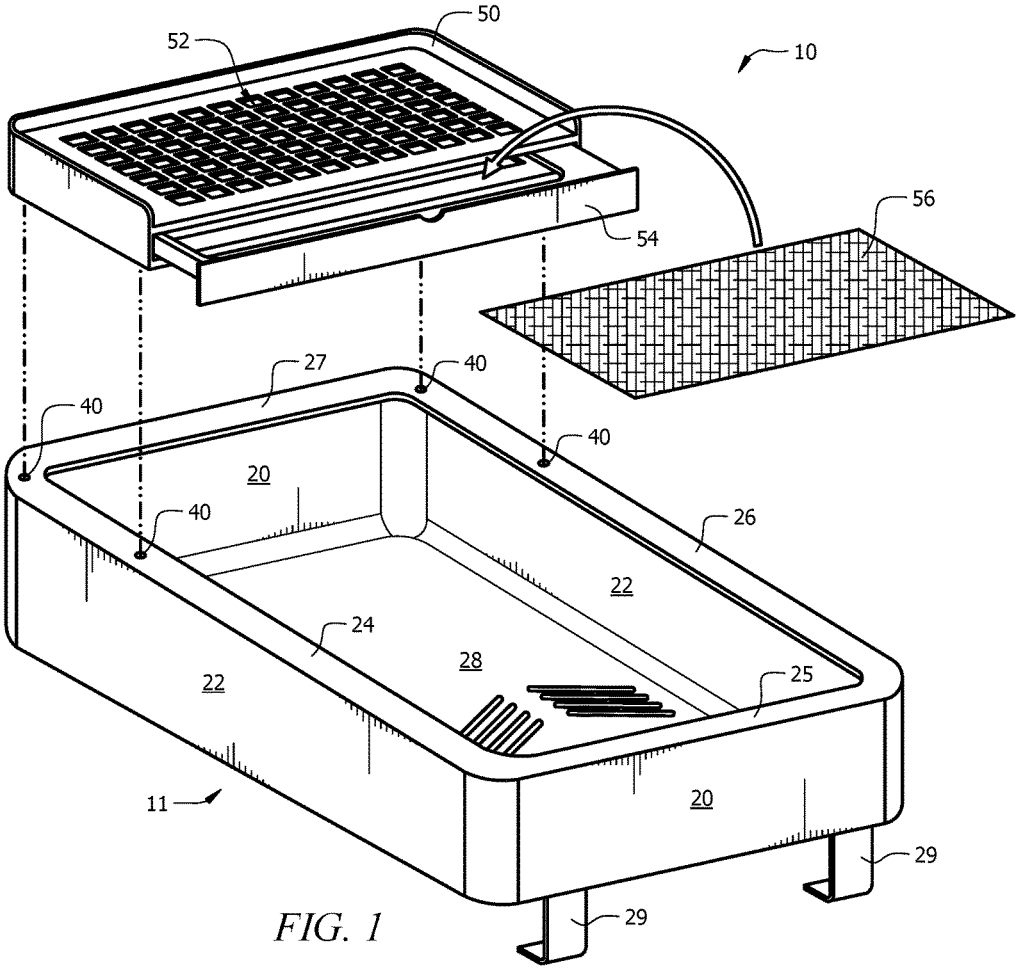
FIG. 1 illustrates a perspective view of a system for wetting a roller with a coating.

Reference will now be made in detail to the presently preferred embodiments of the invention, examples of which are illustrated in the accompanying drawings. Throughout the following detailed description, the same reference numerals refer to the same elements in all figures.

Throughout this description, the term roller refers to a class of devices used to coat a surface with a material. Although the surface is usually a wall, there is no restriction on the surface being a wall, as ceilings, floors, and other objects are often coated using a roller. Rollers come in many shapes and sizes and configurations, all are anticipated equally.

Throughout this description, the material being used to coat the wall or other surface is typically paint, but there is no restriction as to the material used to coat the surface, as rollers are used to coat various surfaces with materials such as stain, varnish, polyurethane, adhesives, etc.

Referring to FIG. 1, a perspective view of a system for wetting a roller 10 with a coating is shown. The system for wetting a roller 10 includes a tray portion 11 that has sides 20/22 and a bottom 28. The sides 20/22 and bottom 28 forms a generally rectangular container for holding a liquid coating material, e.g. paint. In one embodiment, two longer opposing sides 22 are longer than the other two shorter opposing sides 20 so as to allow entry of a roller 62 (see FIG. 2) between the longer opposing sides 22, for the purpose of accumulating coating material (e.g. paint). The bottom 28 of the tray portion 11 slopes having a deep end for storing the coating material (e.g. paint) and a shallow end for rolling off excess paint from the roller 62. The top surface of the sides 20/22 (opposite of the bottom surface 28) include lips 24/25/26/27 that jut inwardly towards each other forming a rim. The lips 24/25/26/27 reduce or eliminate spillage when the coating material (e.g. paint), especially when the system for wetting a roller 10 is moved or jostled. The lips 24/25/26/27 also improve rigidity of the tray portion 11 and provide a location onto which the screen system 50 is attached.

In prior paint trays lacking such lips 24/25/26/27, the paint easily swept over the sides of such, especially when moving as the center of gravity often changes the balance of the paint tray, causing the person moving the paint tray to over compensate, often leading to spilling paint over the sides. The system for wetting a roller 10 has lips that keep the coating material (e.g. paint) from spilling over the sides and also strengthens the sides so that the system for wetting a roller 10 is sturdy enough to hold greater amounts of coating material (e.g. paint). For example, in some embodiments, the system for wetting a roller 10 is constructed of sufficient capacity as to hold one to two gallons of paint, therefore allowing an entire room to be painted without refilling of the system for wetting a roller 10.

Although lips 24/25/26/27 are shown on all sides 20/22, there is no restriction as to which sides have the lips 24/25/26/27.

In some embodiments, the system for wetting a roller 10 includes a screen system 50 having an open mesh area 52. After wetting the roller 62 with the coating material (e.g. paint), the coating material is applied to a surface. Afterwards, any debris is removed from the roller 62 by rolling the roller 62 over the mesh area. As contaminants in the coating material (e.g. paint) accumulate and wind up on the roller 62, these contaminants fall of the roller 62 along with excess paint as the roller 62 is rolled over the mesh are 52. Left to their own, the contaminants would wind up back into the system for wetting a roller 10 and then again on the roller 62. To reduce such contaminants, in some embodiments, a filter 56 is provided beneath the mesh 52 to capture the contaminants. In some embodiments, the filter is a paint strainer material or a screen material made of any suitable material. The screen system 50 and filter 56 also remove contaminants when coating material (e.g. paint) is poured into the tray portion 11 through the mesh 52 and, therefore, through the filter 56.

In some embodiments, the filter 56 is removable/replaceable, and optionally cleanable. In such, the filter 56 is positioned in/on a drawer 54 for easy replacement. As the contaminants build up on the filter 56 and the filter 56 clogs, the filter 56 is removed then cleaned or replaced with another filter 56. In one embodiment, the screen system 50 rests on the lips 24/26/27 at the deeper end of the system for wetting a roller 10. In some embodiments, the screen system 50 is held in place by a series of pegs (not shown) that mate with holes 40 to keep the screen system 50 in place.

In some embodiments, legs or ladder hooks 29 are shown interfaced to the bottom 28 of the system for wetting a roller 10. In such, the legs or ladder hooks 29 elevate an end of the bottom surface 28 to provide the slope of the bottom surface 28.

Figure 2:
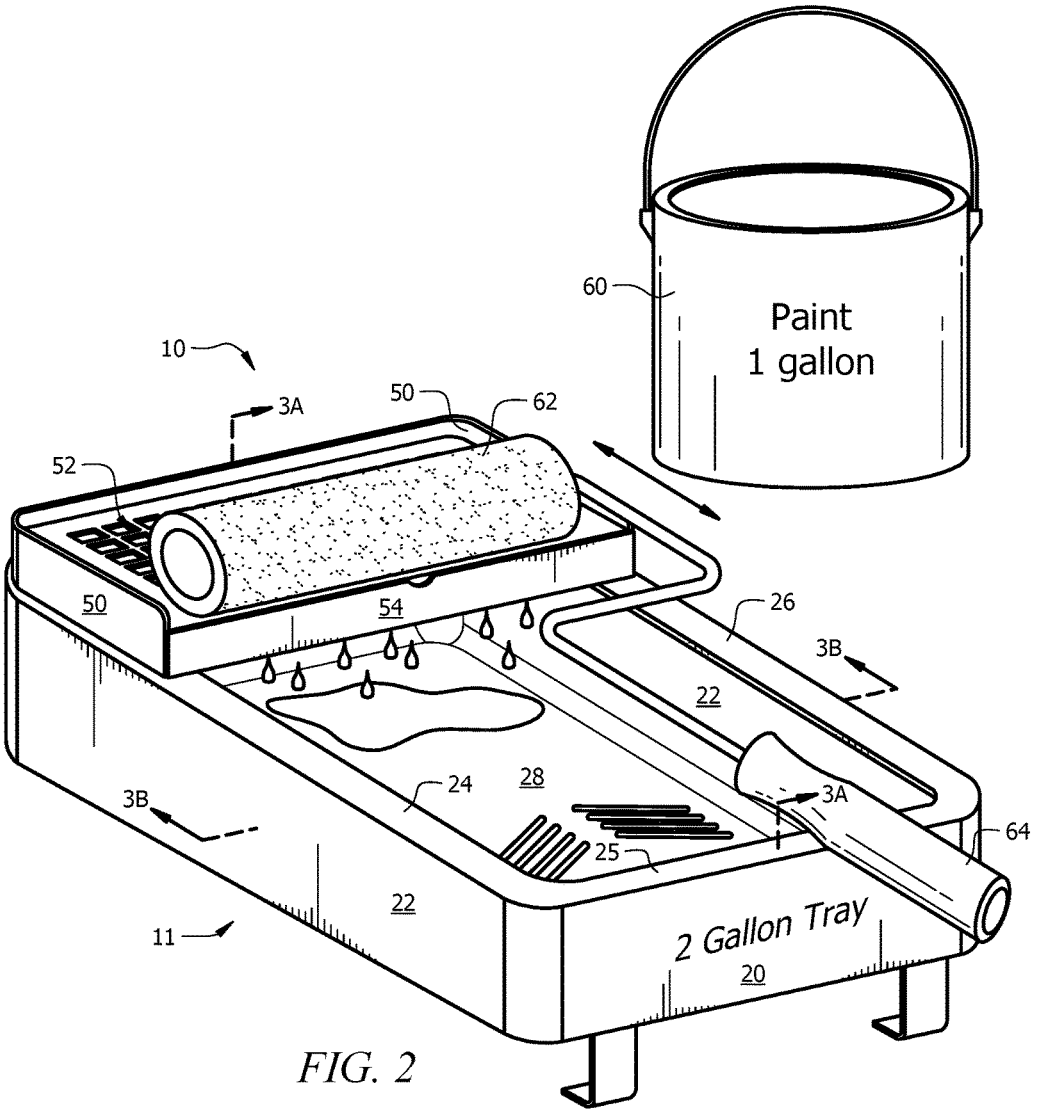
FIG. 2 illustrates a perspective view of the system for wetting a roller in use.

Referring to FIG. 2, a perspective view of the system for wetting a roller 10 is shown in use. Paint from a paint can 60 has been poured into the system for wetting a roller 10, preferably through the mesh 52 and filter 56. If there are contaminants in the paint can 60, pouring of the paint through the mesh 52 filters the contaminants, as sometimes an older can of paint will include globs and/or dried paint fragments. In this view, the paint roller handle 64 rotatably holds the paint roller 62. After applying paint from the roller 62 onto a surface, often contaminants/debris are picked up by the roller 62. To remove the contaminants/debris from the roller 62, the roller is rolled over the mesh 52 and the contaminants/debris are captured by the filter 56 while any paint falls back into the system for wetting a roller 10.

Although any sized system for wetting a roller 10 is anticipated, in some embodiments, the system for wetting a roller 10 holds from one to two gallons of paint, suitable for painting most average sized rooms without the need to refill. In such, painting hygiene is improved as when multiple refilling's are required, paint often collects in the rim of the paint can 60 and drips down the side of the paint can 60.

Figure 3A:
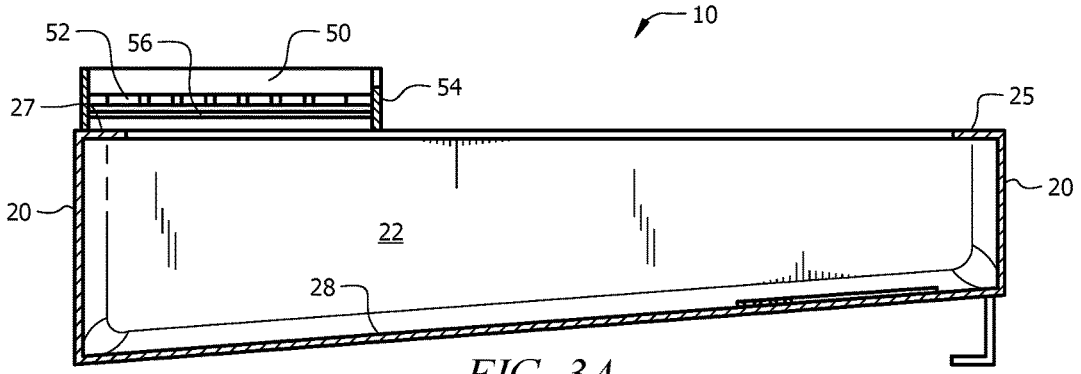
FIG. 3A illustrates a cut-away view of the system for wetting a roller along lines 3A-3A.
Figure 3B:
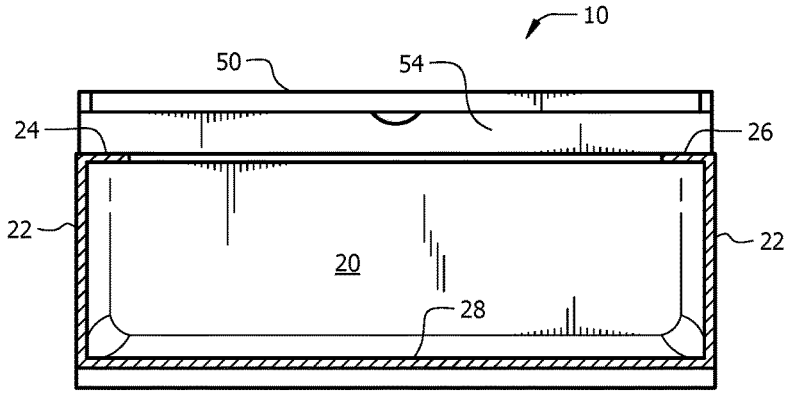
FIG. 3B illustrates a cut-away view of the system for wetting a roller along lines 3B-3B.

Referring to FIGS. 3A and 3B, cut-away views of the system for wetting a roller 10 are shown. In FIG. 3A, the view is along lines 3A-3A of FIG. 2. In FIG. 3B, the view is along lines 3B-3B of FIG. 2.

In FIG. 3A, the slope of the bottom 28 is shown. The lips 25/27 are shown extending toward each other from the tops of the shorter sides 20, although in some embodiments, the sides 24/25/26/27 are of equal lengths. The lips 25/27 extend inwardly creating a rim that prevents at least some paint from splashing out when the paint sloshes due to movement and/or jarring of the system for wetting a roller 10. In some embodiments, the lips 25/27 are as wide as ½ inch to one inch, although there are no limitations on the size of the lips 25/27.

In FIG. 3B, the lips 24/26 are shown extending toward each other from the tops of the longer sides 22, although in some embodiments, the sides 20/22 are of equal lengths. The lips 24/26 extend inwardly creating a rim that prevents at least some paint from splashing out when the paint sloshes due to movement and/or jarring of the system for wetting a roller 10. In some embodiments, the lips 24/26 are as wide as ½ inch to one inch, although there are no limitations on the size of the lips 24/26. In some embodiments, the width of the lips 24/25/26/27 are substantially the same, though there is no restriction that the widths of the lips 24/25/26/27 be the same.

As shown, the bottom surface 28 of the paint tray 11 slopes so that the coating material (e.g. paint) accumulates at the deeper end and the roller 62 is rolled over the shallow area to spread the coating material onto the roller 62. Although the legs or ladder hooks 29 provide the elevation of one end of the paint tray 11 as shown in FIG. 3A, any system for providing this elevations is anticipated, including having equal height walls 20/22 with the bottom surface 28 formed at an angle within the walls 20/22.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An apparatus for wetting a roller, the apparatus comprising:

a liquid containment area having a first side wall, a second side wall, a first end wall and a second end wall, and a sloping bottom section connected to form a rectangular container capable of holding a liquid, the sloping bottom section sloping such that a first end of the rectangular container is deeper than a distal opposing end such that the liquid tends to drain and pool in the first end;

a lip extending inwardly continuously around a top edge of each of the first side wall, the second side wall, the first end wall, and the second end wall, the lip for reducing spilling of paint from the apparatus for wetting the roller;

a roller cleaning mesh removably mounted on the lip by two or more pegs that insert into holes in the lip above the first end, the roller cleaning mesh for rolling a roller over to remove debris from the roller; and a filter beneath the roller cleaning mesh, the filter for filtering out contaminants from the roller.

2. The apparatus of claim 1, further comprising legs/ladder hooks affixed to an outside surface of the bottom section at the distal opposing end.

3. The apparatus of claim 1, wherein the filter is removable and replaceable.

4. The apparatus of claim 3, wherein the filter is a screen.

5. The apparatus of claim 1, wherein the filter is removable and replaceable by way of a drawer, the drawer located beneath the roller cleaning mesh, the drawer containing the filter.

6. The apparatus of claim 5, wherein the filter is a screen.

7. The apparatus of claim 1, wherein the lip extends inwardly from the top edge of each of the first side wall, the second side wall, the first end wall, and the second end wall by at least ½ inch.

8. A system for wetting a roller, the system comprising:

a liquid containment area having a first side wall, a second side wall, a first end wall and a second end wall, the ends of such connected to form a rectangular wall set;

the liquid containment area having a bottom section connected to bottom edges of the first side wall, the second side wall, the first end wall and the second end wall, forming a rectangular container capable of containing a liquid, the bottom section formed such that a first end of the rectangular container is deeper than an opposing second end;

a lip extending inwardly from a top edge of each of the first side wall, the second side wall, the first end wall, and the second end wall, the lip for reducing spilling of the liquid from the system for wetting the roller; and a roller cleaning mesh removably mounted on the lip and extending over the first end of the rectangular container, the roller cleaning mesh resting on top of the lip, and the roller cleaning mesh for rolling the roller over to remove contaminants; and a filter beneath the roller cleaning mesh, the filter for filtering out the contaminants from the roller;

wherein the filter is removable and replaceable by way of a drawer, the drawer located beneath the roller cleaning mesh, the drawer containing the filter.

9. The system of claim 8, further comprising legs/ladder hooks affixed to the bottom section at a distal second end near the second end wall.

10. The system of claim 8, wherein the filter is removable and replaceable.

11. The system of claim 8, wherein the liquid is paint.

* * * * *